US009004635B2

(12) United States Patent
Biglari et al.

(10) Patent No.: US 9,004,635 B2
(45) Date of Patent: Apr. 14, 2015

(54) METHOD TO EXECUTE A PAUSE FUNCTION DURING THE PRINT OPERATION IN AN INKJET PRINTING

(75) Inventors: Mehrad Biglari, Munich (DE); Joachim Samweber, Eichenau (DE); Peter Thiemann, Munich (DE)

(73) Assignee: Océ Printing Systems GmbH, Poing (DE)

( * ) Notice: Subject to any disclaimer, the term of this patent is extended or adjusted under 35 U.S.C. 154(b) by 294 days.

(21) Appl. No.: 13/351,360

(22) Filed: Jan. 17, 2012

(65) Prior Publication Data

US 2012/0182343 A1 Jul. 19, 2012

(30) Foreign Application Priority Data

Jan. 17, 2011 (DE) ..... 10 2011 000 174

(51) Int. Cl.
*B41J 29/38* (2006.01)
*B41J 11/42* (2006.01)

(52) U.S. Cl.
CPC ..... *B41J 11/425* (2013.01)

(58) Field of Classification Search
None
See application file for complete search history.

(56) References Cited

U.S. PATENT DOCUMENTS

| | | | | |
|---|---|---|---|---|
| 6,137,967 | A | 10/2000 | Laussermair et al. | |
| 6,431,674 | B2 | 8/2002 | Suzuki et al. | |
| 6,523,932 | B2 | 2/2003 | Johnson | |
| 2002/0093546 | A1 * | 7/2002 | Johnson | 347/35 |
| 2005/0219342 | A1 * | 10/2005 | Kachi | 347/102 |
| 2007/0064029 | A1 * | 3/2007 | Edwards et al. | 347/8 |
| 2009/0027716 | A1 * | 1/2009 | Kuhn et al. | 358/1.15 |
| 2011/0280638 | A1 * | 11/2011 | Eun | 399/394 |

FOREIGN PATENT DOCUMENTS

| | | | |
|---|---|---|---|
| DE | 60224121 | T2 | 7/2002 |
| EP | 0788882 | B1 | 7/2002 |

* cited by examiner

*Primary Examiner* — Geoffrey Mruk
*Assistant Examiner* — Bradley Thies
(74) *Attorney, Agent, or Firm* — Schiff Hardin LLP

(57) ABSTRACT

In a method to execute a pause function in an inkjet printing system with at least one printing apparatus, the pause function is triggered to reduce a feed speed of the printing substrate web from a speed during printing operation to a predetermined speed for a predetermined duration. The duration is selected so that the printing substrate has suitable properties with regard to at least one of the elements selected from the group consisting of moisture and temperature under the printing unit of the printing apparatus at an end of the pause function. After ending the pause function, the printing substrate web is accelerated again to the speed during the printing operation.

5 Claims, 2 Drawing Sheets

Prior art

METHOD TO EXECUTE A PAUSE FUNCTION DURING THE PRINT OPERATION IN AN INKJET PRINTING

BACKGROUND

Inkjet printing apparatuses can be used for single-color or multicolor printing of a printing substrate, for example a belt-shaped recording material made of the most varied materials (paper, for example). The design of such inkjet printing apparatuses is known; see for example EP 0 788 882 B1. Inkjet printing apparatuses that operate according to the Drop on Demand (DoD) principle have a print head or multiple print heads with nozzles comprising ink channels, the activators of which nozzles—controlled by a print controller—excite ink droplets in the direction of the printing substrate web, which droplets are directed towards the printing substrate in order to apply print dots there for a print image. The activators can generate ink droplets thermally (bubble jet) or piezoelectrically.

Given printing of a printing substrate web, it is sometimes necessary to stop the printing substrate web in a pause function during the printing operation, for example in order to monitor the register quality after printing a print job, or in order to correct problems in the post-processing of the printing substrate web. After the resumption of the printing substrate web, print image disruptions can then occur at those web segments that were located directly under the print heads after activation of the pause function. Due to the relatively large transfer printing zone in inkjet printing apparatuses (inkjet printing systems, for example), in particular in color printing, the print image disruptions created due to the pause correspondingly cause a great deal of maculature. The occurring print image defects contain print image distortions, color register errors and trapezoidal print image distortions. The causes for these are the swelling or shrinking of the printing substrate web during the pause, and the position shifts of the printing substrate web below the print heads that are linked with this.

These problems are explained using prior art FIG. 1. A printing unit 1 and a printer controller 2 from a printing apparatus DR are shown. The printing unit 1, which has print bars 4 with print heads 5 in series (as viewed in the transport direction of the printing substrate web 3) is arranged along a printing substrate web 3. In color printing, for example, one print bar 4 is respectively provided per color to be printed. The printing substrate web 3 is moved past the print bars 4 with the aid of a discharge roller 9; it is thereby placed on a saddle with guide rollers 8. Arranged at the input of the printing unit 1 is a rotary encoder wheel 6 that is driven by the printing substrate web 3 and that generates rotary encoder pulses depending on the feed motion of the printing substrate web 3, which rotary encoder pulses are supplied to the printer controller 2 and are used by the print controller 2 in order to establish the point in time of the initiation of the print process at the individual print heads 5. The printing substrate web 3 is supplied to the rotary encoder wheel 6 by a drive roller 7 arranged before the rotary encoder wheel 6.

In FIG. 1 it is now shown in principle how the printing substrate web 3 can be affected in the individual web segments BA through the printing apparatus DR by the printing unit 1 or the environmental air, for example given a standstill of the printing apparatus DR. In the web segment BA1 between drive roller 7 and rotary encoder wheel 6, the print substrate web 3 is exposed to environmental air, with the consequence that here a swelling of the print substrate web 3 can occur due to the humidity of the environmental air. The change to the print substrate web 3 that is caused by this in the longitudinal direction is compensated with the aid of the rotary encoder wheel 6, however. In the web segment BA2 after the rotary encoder wheel 6 up to the printing unit 1, a swelling of the print substrate web 3 due to the environmental air can likewise occur which, however, remains unaccounted for by the rotary encoder wheel 6. This also applies to the web segment BA3 under the print heads 5 of the printing unit 1; there the print substrate web 3 can shrink due to the operating temperature of the print heads 5; however the printing substrate web 3 is also exposed to the environmental air, such that the web segment BA3 can swell due to the moisture in the environmental air, in particular given greater distances between the print bars 4. The two influences overlap. The printing substrate web 3 is thus exposed to different environmental influences from the drive roller 7 up to the discharge roller 9, which different environmental influences can lead to a shrinking or to a swelling of the printing substrate web 3. This can lead to the print image errors mentioned above, in particular if the printing process is started again after a pause during the print operation.

Given triggering of the pause function, the following effects on the printing substrate web 3 are thus to be considered:

- Temperature and moisture difference between the print substrate web 3 and the environmental air, with the swelling or shrinking of said print substrate web 3 that are thereby incurred with this.
- Temperature difference of the print heads 5 relative to the print substrate web 3, with the shrinking of said print substrate web 3 that is incurred with this.

SUMMARY

It is an object to specify a method in which the unwanted influences of the temperature and the environmental air on the print substrate web—and therefore on the print image—after triggering a pause function are minimized, in particular after ending a print pause.

In a method to execute a pause function in an inkjet printing system with at least one printing apparatus, the pause function is triggered to reduce a feed speed of the printing substrate web from a speed during printing operation to a predetermined speed for a predetermined duration. The duration is selected so that the printing substrate has suitable properties with regard to at least one of the elements selected from the group consisting of moisture and temperature under the printing unit of the printing apparatus at an end of the pause function. After ending the pause function, the printing substrate web is accelerated again to the speed during the printing operation.

DESCRIPTION OF EXEMPLARY PREFERRED EMBODIMENTS

Figure 1:
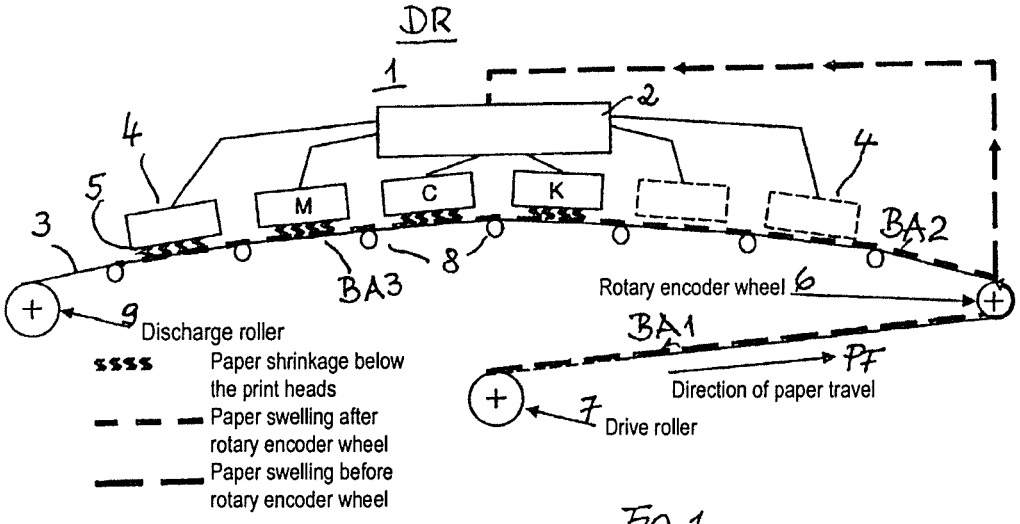
FIG. 1 is a principle representation of a printing unit of an inkjet printing apparatus.

For the purposes of promoting an understanding of the principles of the invention, reference will now be made to the preferred exemplary embodiments/best mode illustrated in the drawings and specific language will be used to describe the same. It will nevertheless be understood that no limitation of the scope of the invention is thereby intended, and such alterations and further modifications in the illustrated exemplary embodiments and such further applications of the principles of the invention as illustrated as would normally occur to one skilled in the art to which the invention relates are included.

According to one exemplary embodiment, with triggering of the pause function the feed speed of the printing substrate web is reduced from the operating speed used in the print operation to a predetermined value for a predetermined time period. The time period can be selected so that, upon ending the pause, a printing substrate web with properties suitable for printing (with regard to the moisture and/or temperature) is presented under the printing unit of the printing apparatus; for example, the printing substrate web has adapted to the environmental air with regard to the moisture and the temperature.

After triggering the pause function, in a first exemplary embodiment the feed speed of the printing substrate web can be reduced from the operating speed to a predetermined speed for a predetermined time period in a lead time upon printing, and after expiration of the lead time period the printing substrate web can be stopped for a pause time of 1 min (for example) in order to be able to subsequently accelerate it to the operating speed again.

In a second exemplary embodiment, after triggering the pause function the feed speed of the printing substrate web can be reduced from the operating speed upon printing to a predetermined speed for the entire pause time (of 1 min, for example) in order to be accelerated to the operating speed again at the end of the pause.

The advantage of the method according to the exemplary embodiment is that a web segment of the printing substrate web is situated under the printing unit during the pause and after ending the pause, which printing unit has values suitable for printing with regard to temperature and/or moisture. These are values that the printing substrate web has when this has adapted to the environmental air with regard to moisture and temperature.

Figure 2:
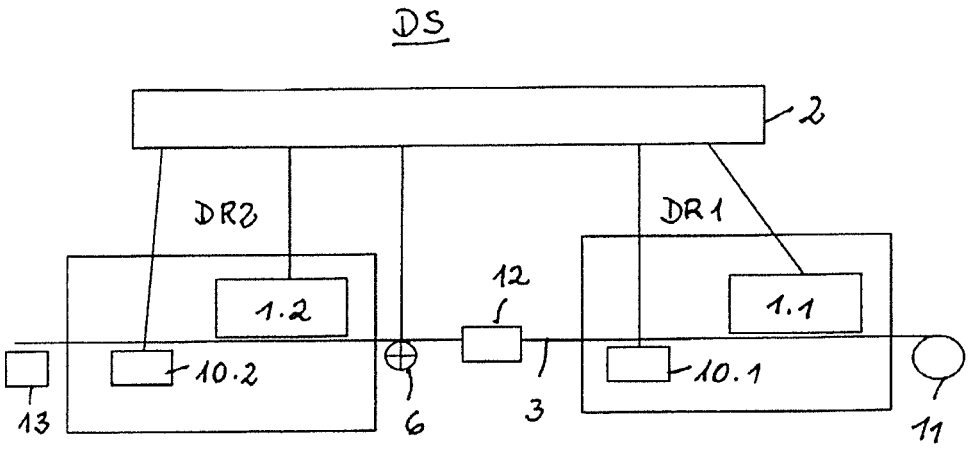
FIG. 2 is a principle representation of a duplex printing system with two printing apparatuses for printing to the front side and rear side of a printing substrate web.
Figure 3A:
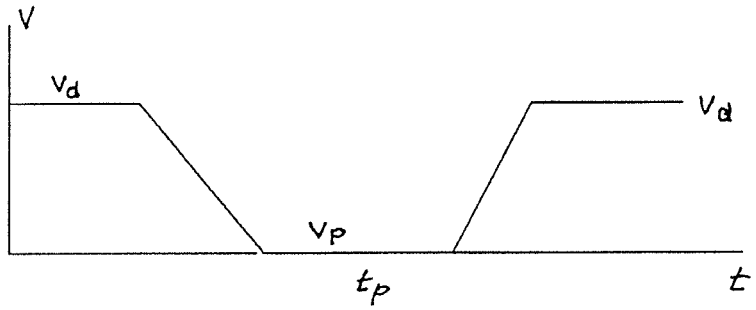
FIGS. 3*a*-3*c* are diagrams that show the dependency of the feed speed v of the printing substrate web on the time t in the various exemplary embodiments of the pause function.
Figure 3B:
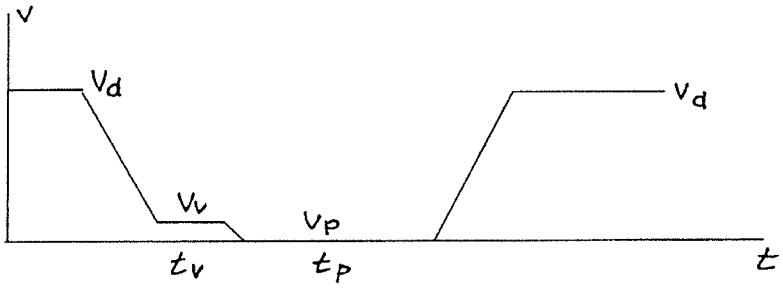
Figure 3C:
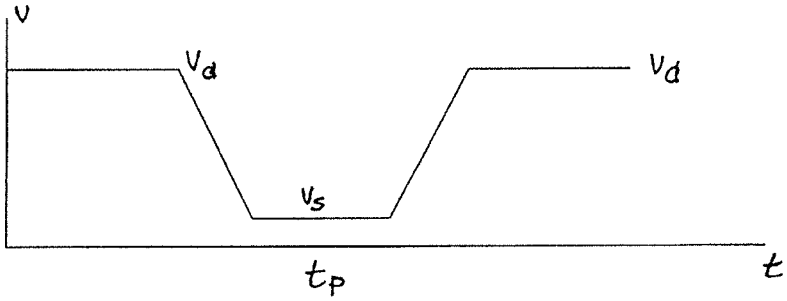

An exemplary embodiment is presented in FIG. 2 and with the explanations of FIGS. 3*a*-3*c*.

Depending on the requirements of the print operation of an inkjet printing apparatus, two different embodiments of the pause function according to the exemplary embodiment are realized in the print jobs to be processed or at the apparatuses for post-processing the printing substrate web:

1: Downtime pause with lead time

2: Creep pause

Both pause variants lead to an improvement of the print quality by reducing the aforementioned print image disruptions.

I. Application of the exemplary embodiment in a printing apparatus DR (FIG. 1)

1. Downtime Pause with Lead Time

In the downtime pause with lead time, after operating a pause button to interrupt the print operation the feed speed of the printing substrate web 3 is reduced for a predetermined time period $t_v$ (FIG. 3*b*) from the operating speed $v_d$ to a speed $v_v$ before the printing apparatus DR is stopped. For example, the feed speed of the printing substrate web 3 can be reduced to $v_v$=0.1 m/sec to 0.3 m/sec for $t_v$=1 to 3 min. The web segments BA2, BA1 are thereby adapted (in terms of the temperature and humidity) to the environmental air and are transported under the printing unit 1. At most, small, negligible position fluctuations of the printing substrate web 3 then occur in the following pause time $t_p$. After ending the pause, segments of the printing substrate web 3 that have suitable properties (with regard to moisture or temperature) in the print operation are located under the printing unit 1. The printing substrate web 3 is subsequently accelerated again to the operating speed $v_d$.

2. Creep Pause

In the creep pause (FIG. 3*c*), upon operation of the pause button the velocity of the printing substrate web 3 is reduced from the operating speed $v_d$ to the creep velocity $v_s$, for example to $v_s$=0.001 m/s to 0.015 m/s for the pause time $t_p$. In this variant of the pause function, a standstill of the printing substrate web 3 does not occur, such that new printing substrate web 3 is continuously transported to the printing unit 1 and a shrinking of the printing substrate web 3 due to a temperature difference or its expansion due to moisture in the environmental air cannot have any effect since these influencing factors also occur in the printing operation and have already been compensated. A possibly arising slack of the printing substrate web 3 after the printing apparatus DR can then be taken up by the devices 13 (FIG. 2) for post-processing the printing substrate web 3.

II. Application of the Exemplary Embodiment in a Duplex Printing System

1. Explanation of the Special Problems in a Duplex Printing System

Special problems occur in the operation of a duplex printing system. These problems and their solution are described using FIG. 2. A printing system DS with two printing apparatuses DR1, DR2 (duplex printer) is shown in principle in FIG. 2. Only the components of each printing apparatus DR that are required to explain the preferred exemplary embodiment are shown; the remaining components can be learned from the prior art, just like the design of the individual components. The printing unit 1 and a drying unit 10 of each printing apparatus DR are shown in FIG. 2. Furthermore, a storage roller 11 of the printing substrate web 3 is delivered from the printing substrate web 3 to the first printing apparatus DR1, and a turning unit 12 and the rotary encoder wheel 6 as shown between the printing apparatuses DR1, DR2. For example, if the front side of the printing substrate web 3 is printed with the printing apparatus DR1, the back side is printed with the printing apparatus DR2. The printing substrate web 3 is turned by the turning unit 12 between the printing apparatuses DR1, DR2. The feed of the printing substrate web 3 is measured with the rotary encoder wheel 6, and the measurement result is supplied to the print controller 2. A rotary encoder wheel can also be provided at the input of the first printing apparatus DR1. The print controller 2 receives the measurement signals from the rotary encoder wheel 6 and controls the printing units 1 and the drying units 10 in a known manner. The printing substrate web 3 printed by the second printing apparatus DR2 is subsequently supplied to the apparatuses 13 for post-processing.

If the pause function in such a duplex printer without application of the exemplary embodiment is examined, the different causes for the swelling or shrinking of the printing substrate web 3 in the printing apparatuses DR1 and DR2 are to be considered:

Relationships in the first printing apparatus DR1:

For example, the print heads 5 of the printing unit 1.1 have an operating temperature of approximately 32° C. The resulting temperature difference from the temperature of the printing substrate web 3 leads to a shrinking of the printing substrate web 3 that is located directly below the print heads. This shrinking of the printing substrate web 3 and the movements of the printing substrate web 3 in the longitudinal direction and in the transversal direction that are connected with this cannot be registered by a rotary encoder wheel arranged at the input of the printing unit 1.1. After ending the pause, print quality defects therefore result at the first printing apparatus DR1.

Relationships in the second printing apparatus DR2:

The printing substrate web 3 that has already been dried in the drying unit 10.1 in the first printing apparatus DR1 after the printing process takes up moisture from the environmental air during the pause, which moisture leads to swelling of the printing substrate web 3. The swelling of the printing substrate web 3 causes a length change of the printing substrate web 3 in the longitudinal direction and transversal direction both before and after the rotary encoder wheel 6. The swelling of the printing substrate web 3 before the rotary encoder wheel 6, and the web movement in the longitudinal direction that is connected with this, are registered by the rotary encoder wheel 6 and communicated to the printer controller 2, which accordingly corrects the point in time of the activation of the print heads 5 of the printing unit 1.2. The swelling of the printing substrate web 3 after the rotary encoder wheel 6, and the web movement connected with this (also that of the printing substrate web 3 below the print heads of the printing unit 1.2), cannot be registered by the rotary encoder wheel 6, which is why print pulses corresponding to the movement of the printing substrate web 3 also cannot be supplied to the print heads. This has an effect in the form of a print image distortion. A shrinking of the printing substrate web 3 also occurs below the print heads 5 of the second printing unit 1.2. However, here the shrinking of the printing substrate web 3 counteracts the swelling of the printing substrate web 3 due to the moisture of the environmental air and thus reduces the print image errors resulting from this.

2. Solution to the Problems in the Duplex Printing System that are Illustrated Above The measures of the preferred embodiment to avoid the effect of these influences on the printing substrate web 3 (and therefore on the print image) now have different effects in the two printing apparatuses DR1, DR2 in a duplex printing system DS.

2.1 Pause with Lead Time a) Relationships in the Second Printing Apparatus DR2

During operation with reduced speed of the printing substrate web 3 during the pause lead time $t_v$, the printing substrate web 3 is provided with more time in order to acquire moisture via the environmental air, such that the largest portion of the swelling of the printing substrate web 3 has occurred with the standstill of the printing substrate web 3 at the beginning of the pause. In order to bolster this effect, additional measures can be taken that affect the take-up of the moisture by the printing substrate web 3, insofar as the corresponding means are provided at the printing apparatus DR:

- The printing substrate web 3 can additionally be cooled with an existing cooling device.
- The drying unit 10.1 for the printing substrate web 3 in the printing apparatus DR1 can be deactivated.
- An air blower can be arranged in the cross-turning region 12 before the second printing apparatus DR2.

b) Relationships in the first printing apparatus DR1

Here measures can be taken via which the heating of the printing substrate web 3 in the printing apparatus DR1 is reduced. If the pause button is operated, the temperature of the print heads of the printing unit 1.1 can be reduced (by 2-3° C.) during the pause lead time $t_v$, with the result that the printing substrate web 3 shrinks less below the print heads.

Additional measures can be taken for both printing apparatuses DR1, DR2: for example, in the printing operation the print heads can be moved by up to 1 to 2 mm from the current print head position at the beginning of the pause. A reduction of the heat transfer from the print heads 5 to the printing substrate web 3 is thereby achieved.

2.2 Creep Pause

During the creep pause, upon operation of the pause button the speed of the printing substrate web 3 is only reduced, for example to $v_s$=0.001 m/s to 0.015 m/s. In this variant of the pause function, a standstill of the printing substrate web 3 does not occur. A slack of the printing substrate web 3 that possibly arises after the printing apparatus DR2 must be taken up by the post-processing 13 of the printing substrate web 3.

The printing unit 1 of a printing apparatus DR is shown in principle in FIG. 1, for example that of the printing apparatus DR2 according to FIG. 2. A printing apparatus DR1 can be arranged before the drive roller 7 as viewed in the transport direction of the printing substrate web 3 (arrow PF). Contact with the environmental air can exist both before and after the drive roller 7, with the consequence that the printing substrate web 3 can swell. The degree of the swelling also depends on the temperature of the printing substrate web 3 after leaving the 1st printing apparatus DR1. Dimension changes of the printing substrate web 3 before the rotary encoder wheel 6 are accounted for by the rotary encoder wheel 6. However, dimension changes after the rotary encoder wheel 6 can have a negative effect on the print image. If a pause is now applied during the printing operation, for example to monitor the register quality after printing a print job, the danger exists that the printing substrate web 3 swells or shrinks before and below the second printing unit 1.2, and the print heads 5 of the individual print bars 4 then no longer generate pinpoint print images on the printing substrate web 3 upon resumption of the printing. In order to remedy this problem, according to the exemplary embodiment either the lead time $t_v$ with reduced feed speed $v_v$ of the printing substrate web 3 is inserted before the pause, or the printing substrate web 3 moves with speed $v_s$ in the creep during the pause. The consequence is that the printing substrate web 3 can take up moisture from the environmental air, and thus arrives below the respective printing unit in a state that also exists during the print operation.

Diagrams of the speed v of the printing substrate web 3 plotted over time t for the pause function of a printing apparatus DR result from FIG. 3.

- The feed speed v of the printing substrate web 3 before, during and after the end of a pause in the printing operation without application of the exemplary embodiment is shown in FIG. 3*a*. The printing apparatus DR initially operates in the print operation; if the printing substrate web 3 is transported through the printing apparatus DR with the operating speed $v_d$, the pause function is then initiated and the printing apparatus DR is brought to a standstill ($v_p$=0) for a short time (of $t_p$=1 min, for example). After the pause, the printing substrate web 3 is started again and the printing substrate web 3 is accelerated to the operating speed $v_d$ again.
- The speed curve of the printing substrate web 3 in the operation of the printing apparatus DR in the pause function with lead is shown in FIG. 3*b*. The printing substrate web 3 for the lead time $t_v$ (of 1 to 3 min, for example) is braked from the operating speed $v_d$ to a low speed $v_v$ of 0.1 m/s, for example. During this time, the printing substrate web 3 can take on the moisture and temperature of the environmental air. The printing substrate web 3 is subsequently halted ($v_p$=0), for example for a pause time $t_p$=1 min. During this pause a problem in the post-processing apparatuses can be corrected, for example. After ending the pause, the printing substrate web 3 is accelerated again to operating speed $v_d$.

The lead time $t_v$ can be selected so that the printing substrate web 3 arrives under the printing unit 1, the properties of which correspond in the printing operation and therefore have already been taken into account. For example, the lead time $t_v$ can also be selected so that the web segment BA1 (FIG. 1) arrives under the printing unit 1; or, the lead time $t_v$ can also be selected so that the printing substrate web 3 has arrived at the output of the first printing apparatus DR1 or into the printing unit 1.2 of the second printing apparatus DR2 after the drying unit 10.1.

The pause function with creep can be learned from FIG. 3*c*. After triggering the pause function, the print speed of the printing substrate web 3 is reduced from the operating speed $v_d$ to the creep speed of (for example) $v_s$=0.001 m/s and is transported further with this creep speed $v_s$ during the pause (of $t_p$=1 min, for example). After the pause has expired, the printing substrate web 3 is accelerated again to operating speed $v_d$.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method to execute a pause function in a printing operation of an ink jet printing system with at least one printing apparatus, comprising the steps of:

printing a printing substrate web with a printing unit with print bars having print heads;

triggering the pause function to reduce an operating feed speed of the printing substrate web for the printing operation to a lower feed speed lower than said operating feed speed for a lead time and thereafter stopping the web for a pause time, or to a creep feed speed which is greater than zero for a pause time;

after ending the pause function accelerating the printing substrate web again to the operating feed speed for the printing operation; and selecting the reduction of the operating feed speed so that moisture of an environmental air under the printing unit which causes a swelling and corresponding increased length of the substrate web and a shrinking of the substrate web caused by heating of the substrate web by exposure of the substrate web to temperature beneath the printing unit resulting from a temperature of the printing unit substantially prevents dimension changes of the substrate web to substantially prevent undesired position shift of the substrate web causing print image distortions during said printing operation.

2. The method of claim 1 wherein feed speed of the printing substrate web is measured by a rotary encoder wheel arranged before the printing unit and a measurement result is supplied to a printer controller, and wherein the lead time is selected so that a segment of the printing substrate web that is situated before the rotary encoder wheel has arrived at the printing unit.

3. The method according to claim 1 in which first and second printing apparatuses situated in series are used to print the printing substrate web, and in which the lead time is selected so that a segment of the printing substrate web situated in the first printing apparatus has arrived at a printing unit of the second printing apparatus.

4. The method of claim 1 wherein the printing unit of the printing apparatus is moved away from the printing substrate web after triggering the pause time.

5. The method of claim 1 wherein a temperature of the print heads of the printing unit of the printing apparatus is reduced after triggering the pause time.

* * * * *